United States Patent [19]

Reinwall, Jr.

[11] 3,998,019

[45] Dec. 21, 1976

[54] ROOF PANEL FASTENER AND JOINT CONSTRUCTION

[75] Inventor: Ernest William Reinwall, Jr., McHenry, Ill.

[73] Assignee: Illinois Tool Works Inc., Chicago, Ill.

[22] Filed: Aug. 18, 1975

[21] Appl. No.: 605,473

[52] U.S. Cl. ..... 52/478; 52/520; 52/545; 52/573; 52/588

[51] Int. Cl.[2] ..... E04C 2/08

[58] Field of Search ..... 52/478, 509, 588, 538, 52/520, 521, 528, 573, 545, 547, 549, 760; 151/38; 85/30

[56] References Cited

UNITED STATES PATENTS

| | | | |
|---|---|---|---|
| 1,691,638 | 11/1928 | Carney | 85/50 R |
| 1,882,105 | 10/1932 | Wender | 52/544 |
| 2,317,428 | 4/1943 | Anderson | 52/509 |
| 3,209,503 | 10/1965 | Mostoller | 52/547 |
| 3,304,827 | 2/1967 | Bush | 151/38 |
| 3,309,829 | 3/1967 | Berridge | 52/521 |
| 3,398,496 | 8/1968 | Mischke | 151/38 |
| 3,517,903 | 6/1970 | Gutshall | 85/50 |
| 3,824,756 | 7/1974 | Kessler | 52/521 |

FOREIGN PATENTS OR APPLICATIONS

| | | | |
|---|---|---|---|
| 275,287 | 5/1965 | Australia | 52/520 |
| 289,816 | 1/1968 | Australia | 52/545 |
| 706,575 | 3/1965 | Canada | 52/544 |

*Primary Examiner*—Price C. Faw, Jr.
*Assistant Examiner*—H. E. Raduazo
*Attorney, Agent, or Firm*—Robert W. Beart; Thomas W. Buckman

[57] ABSTRACT

A roof panel joint construction and clip device for use therein to secure abutting edges of panels so that the clip and associated fastener is concealed and so that the panels are capable of expanding or contracting longitudinally due to thermal changes. Abutting edges of roof panels are crimped together with a lip portion of the clip positioned therebetween while the clip is secured to a purlin with a flange portion of the clip including an elongated slot and a spring clamping member positioned between the head of a fastener and the flange.

18 Claims, 10 Drawing Figures

ROOF PANEL FASTENER AND JOINT CONSTRUCTION

BACKGROUND OF THE INVENTION

The present invention relates generally to the interconnection of roof panels and the securement of the roof panels to a supporting structure.

More particularly, the invention relates to a clip device and joint construction which will provide superior pull-up strength and increased resistance to failure resulting from thermal expansion and contraction of commonly used corrugated metal roof panels.

The type of roof construction considered in this invention may typically be secured to the purlin supporting structure by a direct application of a threaded fastener through a portion, preferably the valley of the corrugation and into the purlin. This obviously produces a joint which is inherently difficult to seal from moisture. The joint just described will also not permit thermal expansion or contraction of the roof panels without tearing or otherwise deteriorating the roof panel in the area of the fastened joint.

Other prior art joint constructions utilize a hold-down clip device which is interleaved between abutting and crimped lips on adjacent work panels. The clip is secured directly to the purlin by utilizing an attaching flange portion with a threaded fastener extending through and clamping this flange to the purlin. This type of joint construction has also been found to be deficient in resisting harmful effects of thermal contraction and expansion in addition to certain weaknesses in pull-out strength.

SUMMARY OF THE INVENTION

In contrast to the various prior art devices and methods of attachment, the present invention utilizes a clip with a base flange having an elongated slot which permits the clip to move relative to the purlin and with the expansion or contraction of the panels. The clip further incorporates a spring clamping device over the elongated slot which serves to carefully distribute the clamping load and enhance the pull-off strength of the joint. The invention further incorporates structure on the clip to center the clamping spring member over the elongated slot while providing a predetermined and controlled spring pressure.

It is, therefore, a principal object of the invention to provide a panel joint construction which permits longitudinal expansion and contraction of roof panels.

A further object of the invention is to provide a clip device which is designed to secure abutting panel edges to a purlin in a concealed manner.

A particular advantage of the present invention is the provision of a clip device with a controlled distribution of clamping forces so as to increase the ability to withstand pull-up loads.

Still a further object of the invention is the provision of a clip designed to permit expansion and contraction of roof panels but which provides a controlled preloaded clamping pressure which must first be overcome in the joint.

BRIEF DESCRIPTION OF THE DRAWINGS

Other objects and advantages of the invention will become apparent upon reading the following detailed description and upon a reference to the drawings in which.

DETAILED DESCRIPTION OF THE PREFERRED EMBODIMENT

Figure 1:
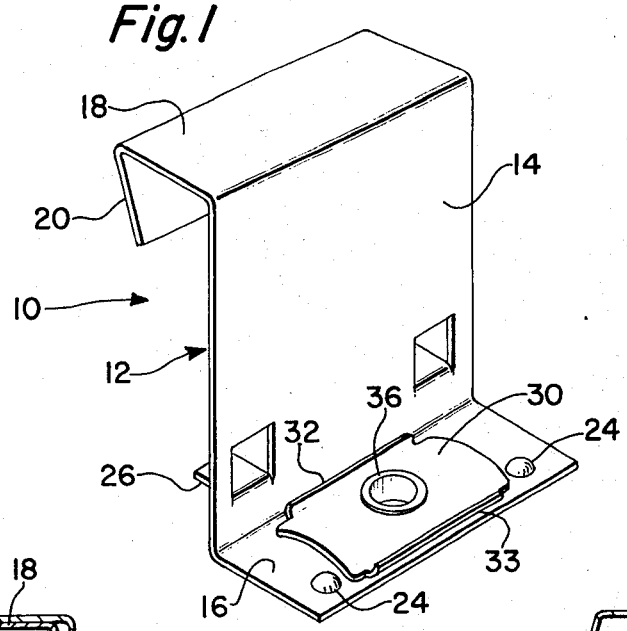
FIG. 1 is a perspective view of a preferred embodiment of the clip device according to the invention.

In FIG. 1 the preassembled roof panel clip device 10 of the present invention is shown to include a clip member 12 of light gauge sheet metal or other suitable material which is formed to include basically a base flange portion 16 and an upstanding web portion 14 terminating in an upper lip 18 which may include a reversely bent portion 20. In the preferred embodiment shown, an arched spring member 30 is positioned and preassembled to the base. The base 16 will be formed with an elongated slot 22 over which an aperture 34 formed in the crest of the spring is positioned for a purpose to be described later herein.

The clip device 10 is designed to secure sheet metal roofing panels to a supporting frame work of structural members. Corrugated panels presenting alternating crests and valleys and inclined side walls connecting adjacent crests and valleys are one form of panel structure in which the invention can be utilized.

Figure 2:
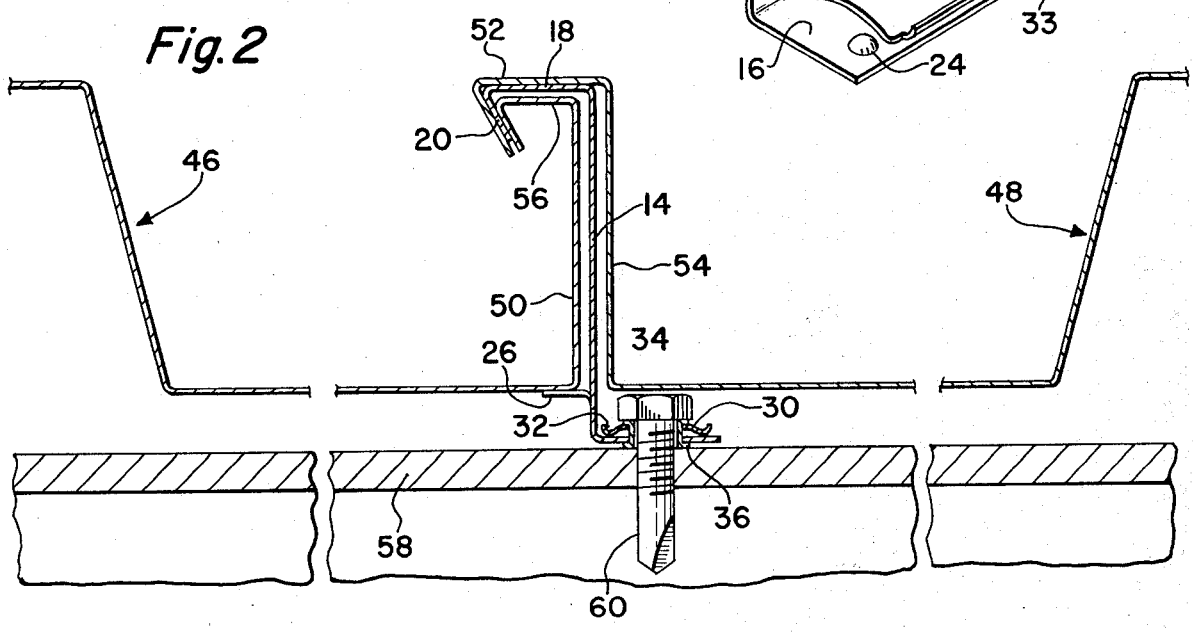
FIG. 2 is a transverse cross-sectional view of a pair of interlocked roof panels joined to a purlin through the use of a clip device of the present invention.
Figure 3:
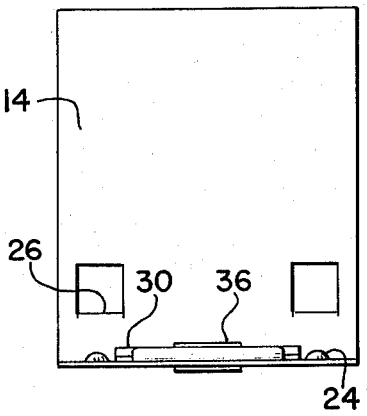
FIG. 3 is a side view of the clip device shown in FIG. 1.
Figure 4:
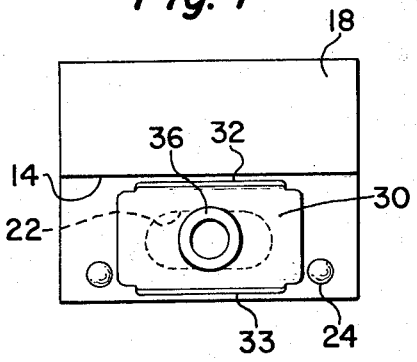
FIG. 4 is a top view of the clip device shown in FIG. 1.
Figure 5:
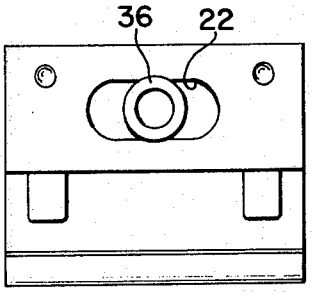
FIG. 5 is a bottom view of the clip device shown in FIG. 1.

Turning to FIG. 2, a joint or seam formed from abutting side edges of a pair of roof panels and the clip device of the invention will be shown where a pair of adjacent panels 46 and 48 are interconnected at their abutting edges with the abutting edges being formed by upstanding portions 50 and 54 respectively. Both of which sections terminate in a lip configuration 52 and 56. Interposed between these abutting roof panel sections is the clip member 12 with its upstanding web portion 14 and lip portions 18 and 20 interleaved between the aforementioned abutting edges. In such a construction, the lip portions may be firmly crimped together effecting a mechanical joint in that region. The base flange 16 of the clip device will have been secured to the supporting purlin structure 58 through the use of a threaded fastener 60 which may be of the self-drilling variety. The shank of the fastener may readily be associated with the aperture 34 in the spring member, which is aligned with the elongated slot 18 in the base portion.

With such a construction, the panels 46 and 48 will be relatively free to expand and contract longitudinally in response to thermal changes since the base flange may move relative to the shank of the fastener due to the provision of the elongate slot 18. The crimped lip connection may be firm enough to provide such a connection between the abutting panel edges and clip so as to allow the edges to move as a unit responsive to thermal changes.

In the particular device illustrated, the clip member 30 provides a variety of functions contributing to the attainment of the objects of the invention and generally to the provision of a structurally sound joint. Spring member 30 preferably is of a rectangular configuration presenting side edges 32 and 33 as lines of clamping abutment with the base flange. Side edge 32 is positioned at the juncture of the base flange 16 and upstanding web 14 while side edge 33 is adjacent to the outer edge of the base flange. This construction serves to distribute the clamping load of the securing fastener 60 over a large area of the flange. This distribution of the clamping load is beneficial in resisting pull-off loads on the clip resulting from severe wind suction loading on the surface of the roof panel which tends to lift the sheets upwardly from the purlin.

The arched spring may also provide an initial frictional force which must be overcome allowing the clip to move longitudinally of the elongated slot and yet permit the longitudinal movement required due to the thermal expansion and contraction of the panel.

The spring member 30 may be initially centered, located and retained in a position where the aperture of the clip is essentially midway of the extremities of the enlongated slot to allow the clip to move in either direction after application. This location and temporary retention of the clip is obtained in a preferred embodiment through the use of the protuberances or dimples 24 formed in the base flange generally on the line of contact of side edge 33 of the spring member. These dimples are of such a height that they may be overridden upon the application of a predetermined longitudinal force and yet serve to retain the spring in a somewhat neutral position.

A further important aspect of the invention is the preloading and the prevention of overcompression of the spring member through the use of an eyelet connection 36. The eyelet extends through the aperture 34 in the spring and the elongated slot 18 and is flanged at the extremities to accomplish the preloading and preassembly of the spring member to the clip 12.

Figure 6:
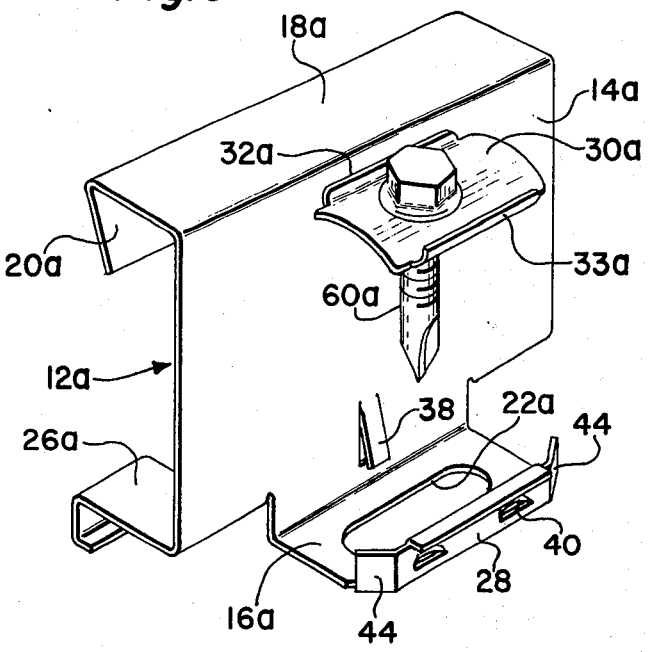
FIG. 6 is an exploded perspective view of another embodiment of the invention.
Figure 10:
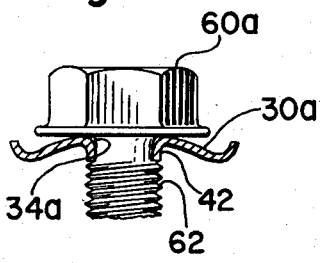
FIG. 10 is an enlarged fragmentary sectional view showing the tubular extrusion of the spring member in the assembly of FIGS. 7–9.
Figure 7:
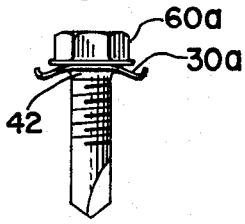
FIG. 7 is an end view of a preassembled fastener and spring member utilized with the clip device shown in FIG. 6.
Figure 8:
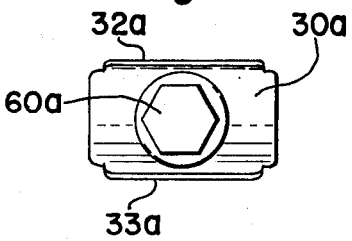
FIG. 8 is a top view of the fastener assembly shown in FIG. 6.
Figure 9:
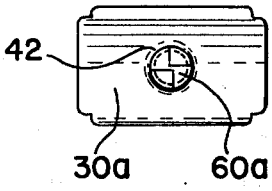
FIG. 9 is a side view of the fastener assembly shown in FIG. 6.

A second embodiment of the clip of the present invention is shown in FIG. 6 with like reference numerals, including the suffix *a*, intended to designate similar elements or components to those shown in FIGS. 1–5.

Clip member 12*a* is designed for use with a preassembled fastener unit including spring member 30*a* and fastener member 60*a*. The spring member and fastener member may be preassembled using conventional techniques, such as the rolling of a thread on a shank after the spring member is assembled on the shank. The crest 62 of the thread thus forms a means to prevent the spring member 30*a* from becoming disassociated from the shank since the aperture 34*a* will be of a smaller diameter than the crest diameter of the thread 62. In this embodiment, the aperture 34*a* is formed downwardly as extrusion portion 42 and which is preferably of a less axial extent than the uncompressed height of the spring member. This construction thereby provides a stop means preventing overcompression of the spring and yet allows the spring to be loaded to a predetermined level over the flange 16*a*.

In operation, the side edge 32*a* of the spring may be aligned with the web surface 14*a* as the fastener 60*a* is driven through the elongated slot and into the purlin. The spring member 30*a* will be free to rotate relative to the shank of the fastener thus permitting such a method of installation. During the driving of the fastener in this manner, the spring member 30*a* will depress and become locked beneath a spring tab or struck-out portion 38 formed in the web of the clip member. The spring tab 38 thus serves to retain the desired spring member in the desired position.

The spring member 30*a* may be generally centered and located so that the fastener 60*a* is midway of the elongated slot 18*a* through the use of inwardly extending spring tabs 44 formed at the extremities of a side wall 28 at the outer edge of the base flange. Detents or spring tab members 40 may be formed in this side wall with a structure and function similar to the spring tab 38. Once installed, the device shown in FIG. 6 operates essentially identically to the device shown in FIG. 1 in forming a joint construction in which the fastener is concealed and which allows for thermal expansion of the roof panels while providing greater resistance to pull off due to the distribution and controlling of the clamping forces.

The clip devices may be provided with a ledge portion 26 or 26*a* to support the valley of a roof panel in the area adjacent to the joint or seam.

Thus, it should be clear from the above description that a joint construction and a clip device for use in a joint construction has been provided which secures, in a concealed fashion, adjoining roof panels and allows the roof panels to expand and contract due to thermal changes without harming the joint or tearing or otherwise deteriorating the panels. The clip device of the present invention further contributes to an increase in pull-out resistance by distributing the clamping load and more particularly distributing a portion of the clamping load at the point of juncture of the web and the base flange of the clip.

While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A device for securing abutting edges of roof panels to each other and to a supporting structure in a concealed manner and to permit expansion and contraction of the roof panels, the assembly comprising a clip member including a base flange portion and lip portion interconnected by an upstanding web portion, an elongate slot formed in the base flange, a spring member preassembled to the flange of the clip member and over the elongate slot, the spring member having an arched configuration providing a pair of spaced elongated flange abutting edges and a crest portion intermediate said edges, an aperture formed through the crest portion of the spring, tubular means extending through the elongate slot assembling the spring to the base in a compressed condition while allowing the clip member to move relative to the spring in the direction of the elongate slot, the clip and the tubular means adapted to receive a fastener member extending through the aperture and the elongate slot to secure the clip to a support structure while allowing limited relative movement between the clip and the support structure.

2. The device of claim 1, wherein the base flange includes means to locate and substantially center the aperture of the spring over the elongate slot.

3. The device of claim 2, wherein the locating means includes raised abutment surfaces on the flanges located adjacent each extremity of the spring member and generally aligned with at least one of the flange abutting edges of the spring.

4. The device of claim 2, wherein the edge of the flange opposite the juncture of the flange with the web portion includes an upstanding wall with end extremities forming spring tabs extending toward the web portion and forming means to locate the spring over the slot.

5. The device of claim 1, wherein the spring member is generally rectangular and bowed transversely providing a pair of flange abutting longitudinal edges, a first of said edges positioned at the juncture of the base flange and web portion.

6. The device of claim 1, wherein the tubular means comprises an eyelet.

7. The device of claim 1, further including spring tabs formed in the web portion of the clip directly adjacent to the upper extremity of the spring, and adapted to retain the spring juxtaposed over the flange.

8. A device for securing abutting edges of roof panels to each other and to supporting structure in a concealed manner, the assembly comprising a clip member including a base flange portion and lip portion interconnected by an upstanding web portion, an elongate slot formed in the base flange, a clamping spring member preassembled to the clip member over the longate slot, the spring member having an arched configuration providing a pair of spaced flange abutting edges and a crest portion intermediate said edges, an aperture formed through the crest, means on the clip member locating, temporarily retaining and centering the aperture of the spring member over the elongated slot, means to preassemble the spring member over the base flange portion wherein the clip member is capable of limited movement relative to the spring member after the influence of the temporary centering means is overcome.

9. The device of claim 8, wherein the spring member is generally rectangular with one longitudinal edge positioned at the line of juncture between the web portion and base flange.

10. The device of claim 8, wherein the spring member is generally rectangular with one edge thereof closely adjacent and lying in a plane substantially coextensive with the plane of the web portion.

11. A panel joint construction including first and second panel units with abutting side edges each having an upstanding web portion terminating in interlocking lip portions, a supporting purlin structure, at least on discrete integral clip member having a base flange, upstanding web portion, and lip portion, the clip member being adapted to be positioned between the abutting edges of the panel units with the base flange of the clip juxtaposed over the purlin structure, an elongate slot formed in the base flange, an arched spring member juxtaposed over the base flange, an aperture in the spring member aligned with at least a portion of the elongate slot and a threaded fastener extending through the aperture, elongated slot and into the purlin to clamp the clip against the purlin in such a manner as to permit selective movement of the clip relative to the purlin and responsive to changes in dimensions of the panel units due to temperature changes.

12. The joint construction of claim 11, including eyelet means preassembling the arched spring member to the flange in a compressed condition.

13. The joint construction of claim 11, including tubular spring compression limitation means extending through the elongate slot and of an axial extent less than the uncompressed height of the arched spring member.

14. The joint construction of claim 11, wherein the spring member is generally rectangular and includes a pair of spaced flange abutting edges serving a distribute the clamping load of the threaded fastener on the flange.

15. The joint construction of claim 11, wherein the flange includes means to initially center the aperture of the spring member between the extremities of the elongate slot.

16. A device for securing abutting edges of roof panels to each other and to a supporting structure in a concealed manner, the device comprising a clip member including a base flange portion and lip portion interconnected by an upstanding web portion, an elongate slot formed in the base flange, a clamping member juxtaposed over the base flange portion, the clamping member having a configuration providing a pair of spaced flange abutting longitudinal edges, one such longitudinal edge positioned substantially at the line of juncture between the web portion and base flange, an aperture formed through the clamping member in alignment with the elongate slot, means to preassemble the clamping member over the base flange portion retaining the clamping member thereon, means on the clip member locating, temporarily retaining, and centering the aperture of the clamping member over the elongate slot wherein the device is adapted to be secured to a supporting structure through the use of a threaded fastener extending through the aperture so that the clip member is capable of limited movement relative to the clamping member after the influence of the temporary centering means is overcome.

17. The device in accordance with claim 16, including a tubular means extending through the elongate slot from the aperture of the clamping member.

18. The device of claim 16, wherein the clamping member is generally rectangular.

* * * * *